US006248008B1

(12) United States Patent
Williams

(10) Patent No.: US 6,248,008 B1
(45) Date of Patent: Jun. 19, 2001

(54) VALVE LAPPING TOOL

(75) Inventor: Danny L. Williams, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 09/487,075

(22) Filed: Jan. 19, 2000

(51) Int. Cl.[7] ..... B24B 1/00

(52) U.S. Cl. ..... 451/430; 451/388

(58) Field of Search ..... 451/430, 442, 451/388

(56) References Cited

U.S. PATENT DOCUMENTS

| | | | | |
|---|---|---|---|---|
| 3,110,137 | * | 11/1963 | Gross | 451/430 X |
| 5,109,564 | * | 5/1992 | Horvath | 15/236.06 |
| 6,042,456 | * | 3/2000 | Foster | 451/430 X |

* cited by examiner

*Primary Examiner*—Joseph J. Hail, III
*Assistant Examiner*—Anthony Ojini
(74) *Attorney, Agent, or Firm*—Banner & Witcoff, Ltd.

(57) ABSTRACT

A valve lapping tool is comprised of a molded plastic and wood particulate composite having knurl pattern on the outside surface of the handle of the tool. Rubber suction cups are attached to the opposite ends of the tool for gripping and rotating a valve on a valve seat of an engine block.

6 Claims, 1 Drawing Sheet

VALVE LAPPING TOOL

BACKGROUND OF THE INVENTION

The present invention relates to a valve lapping tool of the type which is used to help seat the valve of an internal combustion engine.

When replacing and/or repairing the valves of an internal combustion automobile engine, typically, each seat of the engine block, upon which the head of a valve will be seated, must be ground in a precision manner so that the underside of the valve head will properly engage the valve seat. That is, a typical internal combustion engine valve includes a head with an axially projecting stem. The head may have a flat or shaped top surface and an outer edge which is ground or shaped to fit tightly against a seat honed in the valve passage or chamber of an engine block. Machine honing of the mating valve head and engine block seating surfaces does not necessarily provide a totally congruent fit of the valve head against the engine block valve seat. Consequently, the practice has been to insert a lapping compound on the engine block valve seat and to subsequently rotate the head of the valve against the valve seat to thereby shape the opposed parts in a manner which will provide an extremely tight seal when the valve is closed on the engine block valve seat.

Tools utilized to effect the movement of the valve against the valve seat include valve lapper tools. FIGS. 1 and 2 of the application depict versions of valve lapper tools. Typically, as shown in FIG. 1, the tool includes a handle with rubber suction cups at the opposite ends of the handle. The handle is made from wood turned on a lathe to an appropriate shape. Alternatively, as depicted in FIG. 2, the handle may be made from extruded plastic material and will have a uniform cross-section along its entire length with rubber suction cups affixed to each end of the extruded handle.

In practice, the lapper tool is positioned so that a suction cup will fit over and adhere to the top surface of a valve. The tool handle is then rotated between the hands of the mechanic to thereby rotate the valve about the axis of the valve stem causing the underside of the valve to lap against the valve seat and thereby provide a seal of extremely high quality.

The particular tools described are quite useful. However, wooden handled tools often lack necessary durability. Moreover, the wood turning operation to form the handle may, if not properly performed, cause the development of splinters or fissures in the wood. Finally, a wooden handle is susceptible to damage from certain fluids and moisture.

The extruded plastic handle has the disadvantage a very uncomfortable shape for a manual operation. Because it does not have a variable cross-section along its length, it is not as easily controlled or manipulated as a valve lapping tool using a handle made by a wood turning operation. Thus, there has developed the need for an improved valve lapping tool or valve lapper of the type generally described, but one which provides enhanced durability and utility.

SUMMARY OF THE INVENTION

Briefly, the present invention comprises a valve lapper tool including a handle made from a molded plastic and wood fiber composition in combination with suction cups attached to the opposite ends of the handle. The handle, because it is molded, may be molded in a shape very similar to that of the prior art handles made by wooden turning. Additionally, however, the surface of the molded handle may include a an engraved pattern which greatly facilitates the tactile comfort and utility of the tool while also providing an aesthetic appearance. Moreover, the handle materials chosen have a tactile characteristic which facilitates proper usage and are also highly resistant to moisture damage and other types of damage that may result due to the environment in which the tool is used.

Thus, it is an object of the invention to provide an improved valve lapping tool made from a molded plastic composite or composition in combination with rubber suction cups at the end of the longitudinally shaped handle for the tool.

A further object of the invention is to provide a valve lapper tool which has a comfortable feel or tactile sensation.

Another object of the invention is to provide an improved valve lapper tool which is resistant to environmental conditions, such as dampness and degradation by other liquids or materials.

A further object of the invention is to provide a valve lapper tool which is easy to manipulate, rugged and economical.

These and other objects, advantages and features of the invention will be set forth in a detailed description which follows.

BRIEF DESCRIPTION OF THE DRAWINGS

In the detailed description which follows, reference will be made to the drawing comprised of the following figures.

DESCRIPTION OF THE PREFERRED EMBODIMENT

Figure 1:
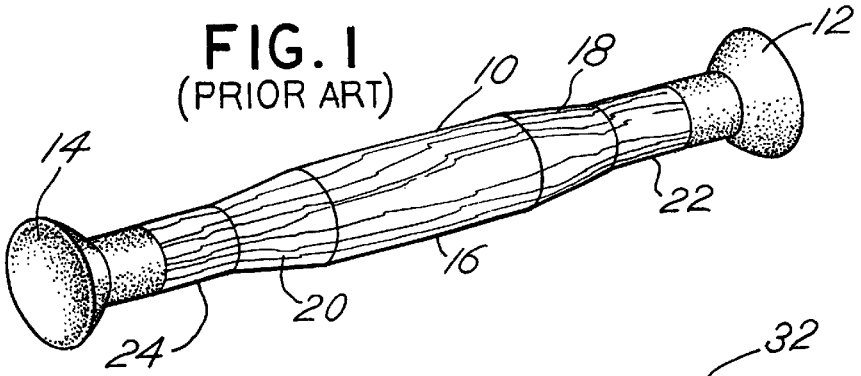
FIG. 1 (PRIOR ART)
FIG. 1 is an isometric view of a prior art valve lapper tool made from wood and rubber suction cups.

Referring to FIG. 1, there is depicted a prior art valve lapper tool which is comprised of a handle 10 and opposite end rubber suction cups 12 and 14 attached to the opposite ends of the handle 10. The handle 10 includes a cylindrical center section 16, oppositely extending frustoconical sections 18,20 and a shaped, connecting rod section 22,24 extending from each frustoconical section 18,20 respectively. The rubber suction cups 12, 14 are attached respectively to the outer ends of the rod sections 22, 24. The handle 20 is made by turning a wooden dowel on a lathe to form the various sections described. The handle 10 is sanded or otherwise treated or coated so as to have a smooth surface. The handle 10, after being formed, is usually be coated with varnish or other coating material to help seal and preserve the handle.

Figure 2:
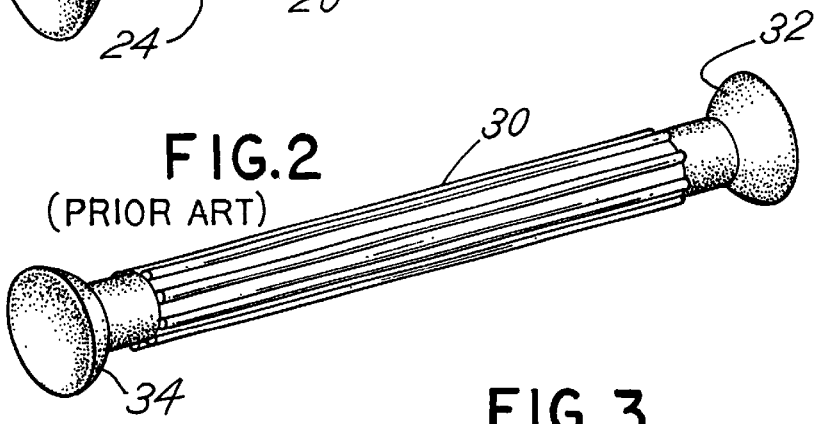
FIG.2 (PRIOR ART)
FIG. 2 is an isometric view of an extruded plastic handle valve lapper tool with rubber suction cups mounted thereon.

FIG. 2 illustrates an alternative prior art construction wherein an extruded handle 30 made from plastic has attached rubber suction cups 32,34 at the opposite ends of the handle 30. The extruded handle 30 has a uniform cross section along its length. The extruded handle 30 includes a number of parallel longitudinal ribs about the circumference of the handle to facilitate gripping of the handle and rotation thereof by manipulation between the hands of a mechanic, for example.

Figure 3:
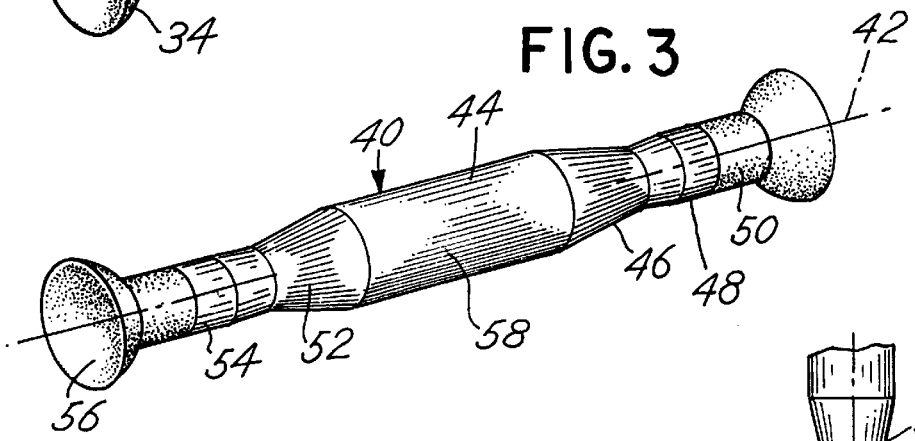
FIG. 3 is an isometric view of the valve lapper tool of the invention depicting the first embodiment thereof.
Figure 5:
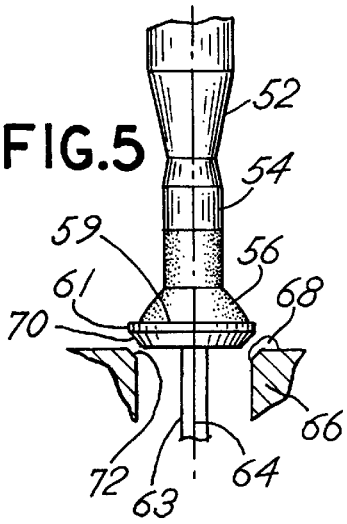
FIG. 5 is a schematic view of the manner of use of the valve lapper tool of the invention.
Figure 4:
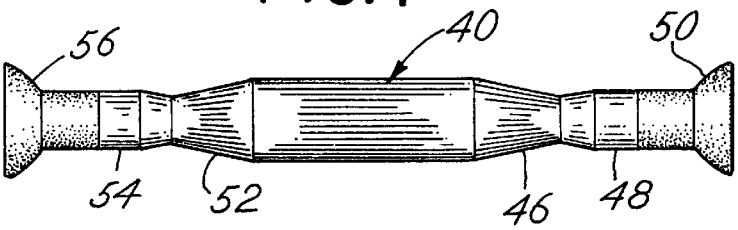
FIG. 4 is a plan or elevation view of the valve lapper tool of FIG. 3.

FIGS. 3 through 5 illustrate the improved valve lapping tool of the present invention. Referring first to FIG. 3, a molded plastic and wood fiber composite handle 40 has a longitudinal axis 42. The handle 40 includes a cylindrical center section 44. A first frustoconical section 46, having a decreasing diameter in the direction extending from the cylindrical section 44, extends from one end of the handle section 44. Frustoconical section 46 connects with an extension 48 and, in turn, has a rubber cup 50 attached thereto. The opposite end of the cylindrical center section 44 includes a frustoconical section 52 which is a mirror image of the section 46. An extension 54 has a rubber suction cup 56 attached thereto.

Importantly, the cylindrical section 44 includes an engraved or pattern comprised of a series of indentations and/or projections 58 on the outside surface of the section 44. The engraved depressions 58 are random, but generally align in a pattern with elements parallel to axis 42 randomly spaced about the outside circumferential surface of the central section 44 of handle 40. However, other patterns are acceptable. Further, the engraved pattern depressions 58 cover or extend along the entire surface of the center section 44. That is, the depressions 58 extend continuously fix between frustoconical sections 46 and 52.

The pattern of depressions 58 has a distinct functional aspect as well as an ornamental aspect. From a functional viewpoint, the depressions 58 enable a mechanic to more easily sense the movement of the lapper tool as it is rotated between the palms of an operator or mechanic. Note that the frustoconical sections 46, 52 provide a means for the mechanic or operator to guide the operation of the lapper tool by placing thumbs against the inclined surfaces 46 and/or 52. Both of the inclined surfaces 46 and 52 are of substantially identical configuration although it is possible to vary the frustoconical configuration of the separate surface 46, 52 to accommodate distinct modes of operation of the valve lapping tool as controlled by positioning the thumb against the surfaces 46, 52.

The choice of material for manufacture of the handle 40 has been found to be important. A preferred material is a wood filled polypropylene having a 60% wood fiber content available from Northwood Plastics, Inc., Sheboygan, Wis. mixed with two (2) parts of polypropylene, eg. Huntsman PPH3502NS polypropylene from Ashland Chemical Co., General Polymers Division. The physical characteristics of the resultant molded material are set forth in the following table:

Performance in Molding Grade HDPE

| PROPERTY | ASTM TEST | UNFILLED HDPE ^ | 2 PARTS HDPE 1 PART UNIFILL - 60 (20% FIBER) | 1 PART HDPE 2 PARTS UNIFILL - 60 (40% FIBER) | UNITS |
|---|---|---|---|---|---|
| Density | D792 | .953 | .994 | 1.071 | g/cc |
| Melt Flow Index | D1238 | 20 | 2.0[b] | 0.7[b] | G/10 min |
| Mold Shrinkage | D955 | 2.1 | 1.21 | 0.66 | % |
| Tensile Strength @ | D638 | 3200 | 2190 | 2180 | psi |
| Yield | | (22.0) | (15.1) | (15.1) | (MPa |
| Tensile Modulus | D638 | n/a | 258,000 | 553,000 | psi |
| | | | (1.8) | (3.8) | Gpa) |
| Elongation | D638 | 25 | 15 | 3.7 | % |
| Flexural Modulus | D790 | 125,000 | 176,000 | 300,000 | psi |
| | | (0.9) | (1.2) | (2.1) | (Gpa) |
| Flexural Strength | D790 | n/a | 5430 | 6240 | psi |
| | | | (37.5) | (43.1) | (MPa |
| Notched Izod Impact | D256 | 0.6 | 0.8 | 0.6 | ft-lbf/in |
| | | (32) | (43) | (32) | (J/m) |
| Un-notched Izod | D256 | n/a | 4.5 | 1.7 | ft-lbf/in |
| Impact | | | (240) | (91) | (J/m) |
| Heat Deflection | D648 | 99 | 109 | 121 | ° F. |
| Temperature | | (37) | (43) | (49) | (° C.) |
| (@ 261 psi) | | | | | |

Performance in Molding Grade Polypropylene

| PROPERTY | ASTM TEST | UNFILLED POLYPRO ^ | 2 PARTS POLYPRO 1 PART UNIFILL - 60 (20% FIBER) | 1 PART POLYPRO 2 PARTS UNIFILL - 60 (40% FIBER) | UNITS |
|---|---|---|---|---|---|
| Density | D792 | .905 | .978 | 1.052 | g/cc |
| Melt Flow Index | D1238 | 35 | 1.3[b] | <0.5[b] | G/10 Min |
| Mold Shrinkage | D955 | 1.91 | 0.92 | 0516 | % |
| Tensile Strength @ | D638 | 4900 | 3680 | 3080 | psi |
| Yield | | (33.8) | (25.4) | (1.1) | (MPa |
| Tensile Modulus | D638 | 203,000 | 435,000 | 585,000 | psi |
| | | (1.4) | (3.0) | (21.1) | GPa) |
| Elongation | D638 | 10 | 4.1 | 2.3 | % |

-continued

Performance in Molding Grade Polypropylene

| PROPERTY | ASTM TEST | UNFILLED POLYPRO ^ | 2 PARTS POLYPRO 1 PART UNIFILL - 60 (20% FIBER) | 1 PART POLYPRO 2 PARTS UNIFILL - 60 (40% FIBER) | UNITS |
|---|---|---|---|---|---|
| Flexural Modulus | D790 | 205,000 (1.4) | 310,000 (2.1) | 396,000 (2.7) | psi (GPa) |
| Flexural Strength | D790 | 5900 (40.7) | 5430 (37.5) | 6240 (43.1) | Psi (MPa |
| Notched Izod Impact | D256 | 0.4 (21.5) | 0.4 (21.5) | 0.6 (32.0) | ft-lbf/in (J/m) |
| Un-notched Izod Impact | D256 | n/a | 2.2 (117) | 3.83 (205) | ft-lbf/in (J/m) |
| Heat Deflection Temperature (@ 264 psi) | D648 | 131 (55) | 143 (62) | 157 (70) | ° F. (° C.) |

other mixtures having similar charachteristics may be utilized.

The embodiment pattern on the handle 40 is preferrably engraving pattern MT11450 with 0.0025 deep depression available from Rawal Engraver Division of Mold-Tech, Villa Park, Ill. Other similar patterns may be substituted.

FIG. 5 illustrates the manner of operation of the tool of FIG. 3. Thus, the rubber suction cup 56 is fitted against the top surface 59 of a valve 61. A depending valve stem 63 defines an axis of rotation 64 for the valve stem in the engine block 66. A lapping compound 68 is inserted in the region between the underside 70 of the valve 61 and the valve seat 72 in the block 66. The lapping tool is then rotated back and forth between the palms of the operator. The thumbs of the operator engage against frustoconical surface sections such as section 46. This facilitates maintenance of balance and control of the tool. The pattern of depressions 58 facilitates engagement of the hands with the tool to provide a sense of rotation and movement of the tool and to give a better indication that the tool is being manipulated in a proper fashion. In this manner, the valve 61 is lapped and the seating between the valve 61 and the seat 72 is enhanced or effected as desired to facilitate repair of the automobile engine.

It is noted that various other patterns of depressions or projections 58 may be incorporated on the cylindrical section 44 in order to accomplish the goals and objectives of the invention. The materials forming the body may also be altered or may the shape of the component parts of the tool. The invention is therefore to be limited only by the following claims and equivalents thereof.

What is claimed is:

1. A valve lapping tool comprising in combination:

an elongate handle having a longitudinal axis and opposite distal ends, said handle having a generally cylindrical central section, said handle also having a first frustoconical section extending from the central section axially with increasing axial extension from the central section, said handle also having a second frustoconical section extending axially from the central section in the opposite direction from the first section, with increasing axial extension from the central section, said sections all being symmetric about the axis, said handle formed from a molded material comprising wood fibrous and plastic material, said wood fibrous and plastic material comprising a polypropylene polymer having a wood fiber content of about 60%, said central section having a cylindrical surface with a pattern molded therein; and a suction cup affixed to each of the opposite distal ends of the handle, said cups being symmetric about the axis and formed for engagement with an engine valve head and for rotating about the axis by rolling the central section manually.

2. A valve lapping tool comprising in combination:

an elongated handle having a longitudinal axis and opposite distal ends, said handle having a generally cylindrical central section, said handle also having a first frustoconical section extending from the central section axially with increasing axial extension from the central section, said handle also having a second frustoconical section extending axially from the central section in the opposite direction from the first section with increasing axial extension from the central section, said sections being symmetric about the axis, said handle formed from a molded material comprised of a combination of wood fibers and a plastic material, said central section having a cylindrical surface with a pattern molded therein; and a suction cup affixed to each of the opposite distal ends of the handle, said cups being symmetric about the axis and formed for engagement with an engine valve head and for rotation about the axis by rolling the central section manually.

3. The tool of claim 1 or 2 wherein the pattern is defined by a uniform pattern over the entire surface of the central section.

4. The tool of claim 1 or 2 wherein the pattern is defined by a uniform pattern of spaced depressions over the surface of the central section.

5. The tool of claim 1 or 2 wherein the surface of the tool includes an engraved pattern having a plurality of depressions in the surface thereof about 0.0025 inches deep.

6. The tool of claim 2 wherein the handle is molded from a combination of wood fibrous and plastic material wherein the plastic material comprises a polypropylene polymer having a wood fiber content of about 60%.

* * * * *